US006283386B1

(12) United States Patent
Van Steenkiste et al.

(10) Patent No.: US 6,283,386 B1
(45) Date of Patent: Sep. 4, 2001

(54) KINETIC SPRAY COATING APPARATUS

(75) Inventors: Thomas H. Van Steenkiste, Ray; John R. Smith, Birmingham; Richard E. Teets, Bloomfield Hills; Jerome J. Moleski, Clinton Township Macomb County; Daniel W. Gorkiewicz, Washington, all of MI (US)

(73) Assignee: National Center for Manufacturing Sciences, Ann Arbor, MI (US)

( * ) Notice: Subject to any disclaimer, the term of this patent is extended or adjusted under 35 U.S.C. 154(b) by 0 days.

(21) Appl. No.: 09/578,076

(22) Filed: May 23, 2000

Related U.S. Application Data

(62) Division of application No. 09/343,016, filed on Jun. 29, 1999, now Pat. No. 6,139,913.

(51) Int. Cl.[7] ..... B05B 7/06

(52) U.S. Cl. ..... 239/427; 239/434.5; 239/79; 417/197; 118/308

(58) Field of Search ..... 239/427, 135, 239/433, 434.5, 423, 79, 80, 85, 338; 417/197, 179; 118/308, 302; 451/102

(56) References Cited

U.S. PATENT DOCUMENTS

| | | | | |
|---|---|---|---|---|
| 2,861,900 | * | 11/1958 | Smith et al. | 427/446 |
| 3,100,724 | | 8/1963 | Rocheville | 118/308 |
| 4,416,421 | * | 11/1983 | Browning | 239/79 |
| 5,302,414 | | 4/1994 | Alkhimov et al. | 427/192 |
| 5,356,672 | * | 10/1994 | Schmitt, III et al. | 118/302 |
| 5,459,811 | * | 10/1995 | Glovan et al. | 239/135 |
| 5,795,626 | * | 8/1998 | Gabel et al. | 451/102 |
| 5,876,267 | * | 3/1999 | Kanda | 451/102 |

OTHER PUBLICATIONS

Surface & Coatings Technology 111 (1999) 62–71, entitled "Kinetic Spray Coatings" by T. H. Van Steenkiste et al.

* cited by examiner

*Primary Examiner*—David A. Scherbel
*Assistant Examiner*—Dinh Q. Nguyen
(74) *Attorney, Agent, or Firm*—Fildes & Outland, P.C.

(57) ABSTRACT

An apparatus is disclosed for kinetic spray coating of substrate surfaces by impingement of air or gas entrained powders of small particles in a range up to at least 106 microns accelerated to supersonic velocity in a spray nozzle. Preferably powders of metals, alloys, polymers and mixtures thereof or with semiconductors or ceramics are entrained in unheated air and passed through an injection tube into a larger flow of heated air for mixing and acceleration through a supersonic nozzle for coating of an article by impingement of the yieldable particles. A preferred apparatus includes a high pressure air supply carrying entrained particles exceeding 50 microns through an injection tube into heated air in a mixing chamber for mixing and acceleration in the nozzle. The mixing chamber is supplied with high pressure heated air through a main air passage having an area ratio relative to the injection tube of at least 80/1.

7 Claims, 2 Drawing Sheets

KINETIC SPRAY COATING APPARATUS

CROSS REFERENCE TO RELATED APPLICATION

This is a division of application Ser. No. 09/343,016 filed on Jun. 29, 1999, was U.S. Pat. No. 6,139,913, entitled Kinetic Spray Coating Method And Apparatus.

FIELD OF THE INVENTION

This invention relates to kinetic spray coating wherein metal and other powders entrained in an air flow are accelerated at relatively low temperatures below their melting points and coated onto a substrate by impact.

BACKGROUND OF THE INVENTION

The art of kinetic spray coating, or cold gas dynamic spray coating, is discussed at length in an article by T. H. Van Steenkiste et al., entitled "Kinetic Spray Coatings", published in Surface and Coatings Technology, Vol. 111, pages 62–71, on Jan. 10, 1999. Extensive background and reference to prior patents and publications is given as well as the current state of the art in this field as summarized by the thirteen listed authors of the referenced article.

The work reported on was conducted with an apparatus developed for the National Center for Manufacturing Services (NCMS) which improved upon the prior work and apparatus reported in U.S. Pat. No. 5,302,414 Alkhimov et al., issued Apr. 12, 1994. These sources have reported the kinetic spray coating of metals and other materials by gas accelerated impact on certain substrates with varying degrees of success using a high pressure kinetic spray system with a kinetic spray nozzle based upon concepts taught by Alkhimov et al. and other sources.

The method involves feeding metallic or other material types in the form of small particles or powder into a high pressure gas flow stream, preferably air, which is then passed through a de Laval type nozzle for acceleration of the gas stream to supersonic flow velocities greater than 1000 m/s and coated on the substrate by impingement on its surface. While useful coatings have been made by the methods and apparatus described in the referenced article and in the prior art, the successful application of these methods has been limited to the use of very small particles in a range of from about 1 to 50 microns in size. The production and handling of such small particles requires special equipment for maintaining the smaller powder sizes in enclosed areas and out of the surrounding atmosphere in which workers or other individuals may be located.

Accordingly, the ability to utilize a kinetic spray coating process for coating metal and other particles larger than 50 microns would provide significant benefits.

SUMMARY OF THE INVENTION

The present invention provides a method and apparatus by which particles of metals, alloys, polymers and mechanical mixtures of the foregoing and with ceramics and semiconductors, having particle sizes in excess of 50 microns, may be applied to substrates using a kinetic spray coating method.

The present invention utilizes a modification of the kinetic spray nozzle of the NCMS system described in the Van Steenkiste et al. article. This system provides a high pressure air flow that is heated up to as much as 650° C. in order to accelerate the gas in the de Laval nozzle to a high velocity in the range of 1000 m/s or more. The velocity is as required to accelerate entrained particles sufficiently for impact coating of the particles against the substrate. The temperatures used with the various materials are below that necessary to cause their melting or thermal softening so that a change in their metallurgical characteristics is not involved.

In the NCMS apparatus, particles are delivered to the main gas stream in a mixing chamber by means of an unheated high pressure air flow fed through a powder feeder injection tube, preferably aligned on the axis of the de Laval nozzle. In a prior apparatus, the diameter of the injection tube in the similar spray nozzle of Alkhimov et al. had a ratio of the main air passage cross-sectional area to powder feeder injection tube cross-sectional area of 5–15/1. The kinetic spray nozzle of the NCMS apparatus, with its higher air pressure system, had a ratio of main air passage diameter to powder feeder injection tube diameter of 4/1 and a comparable ratio of main air passage cross-sectional area to powder feeder injection tube cross-sectional area of 17/1. In both of these cases, the apparatuses were found to be incapable of applying coatings of particles having a particle size in excess of 50 microns.

The present invention has succeeded in increasing the size of particles which can be successfully applied by a kinetic spray process to particles in excess of 100 microns. This has been accomplished by decreasing the diameter of the powder feeder injection tube from 2.45 mm, as used in the spray nozzle of the NCMS apparatus reported in the Van Steenkiste et al. article, to a diameter of 0.89 mm. It has also been found that the deposit efficiency of the larger particles above 50 microns is substantially greater than that of the smaller particles below 50 microns.

While the reasons for the improved operation are not entirely clear, it is theorized that reduced air flow through the powder injection tube results in less reduction of the temperature of the main gas flow through the de Laval nozzle with the result that the larger sized particles are accelerated to a higher velocity adequate for their coating by impact against a substrate, whereas the prior apparatus were incapable of accelerating larger particles to the required velocity. It should be noted that the air flow and particle velocities upon discharge from the nozzle vary roughly as the square root of the gas temperature. Also, the fine particles have been found to be more sensitive to stray gas flow patterns which can deflect the particles, particularly near the substrate, lowering the deposition efficiency. Finally, the fine particles have a high surface to volume ratio which can lead to more oxide in the powder and, therefore, in the coating.

In a further development, a still smaller powder feeder injection tube of 0.508 mm diameter was tested and found also capable of coating large particles between 45 and 106 microns. But, it was also found to be difficult to maintain a uniform feed of large particles through a tube of such small diameter.

As a result of this invention, it is now recognized that the kinetic spray coating of metals and other substances using air entrained particles greater than 50 microns and up to in excess of 100 microns may now be accomplished by proper selection of the characteristics and flow capabilities of the kinetic spray nozzle and accompanying system. It is expected that with further development and testing of the apparatus and method, the size of particles that may be utilized in coating powders may be further increased.

These and other features and advantages of the invention will be more fully understood from the following description of certain exemplary embodiments of the invention taken together with the accompanying drawings.

DETAILED DESCRIPTION OF THE INVENTION

Figure 1:
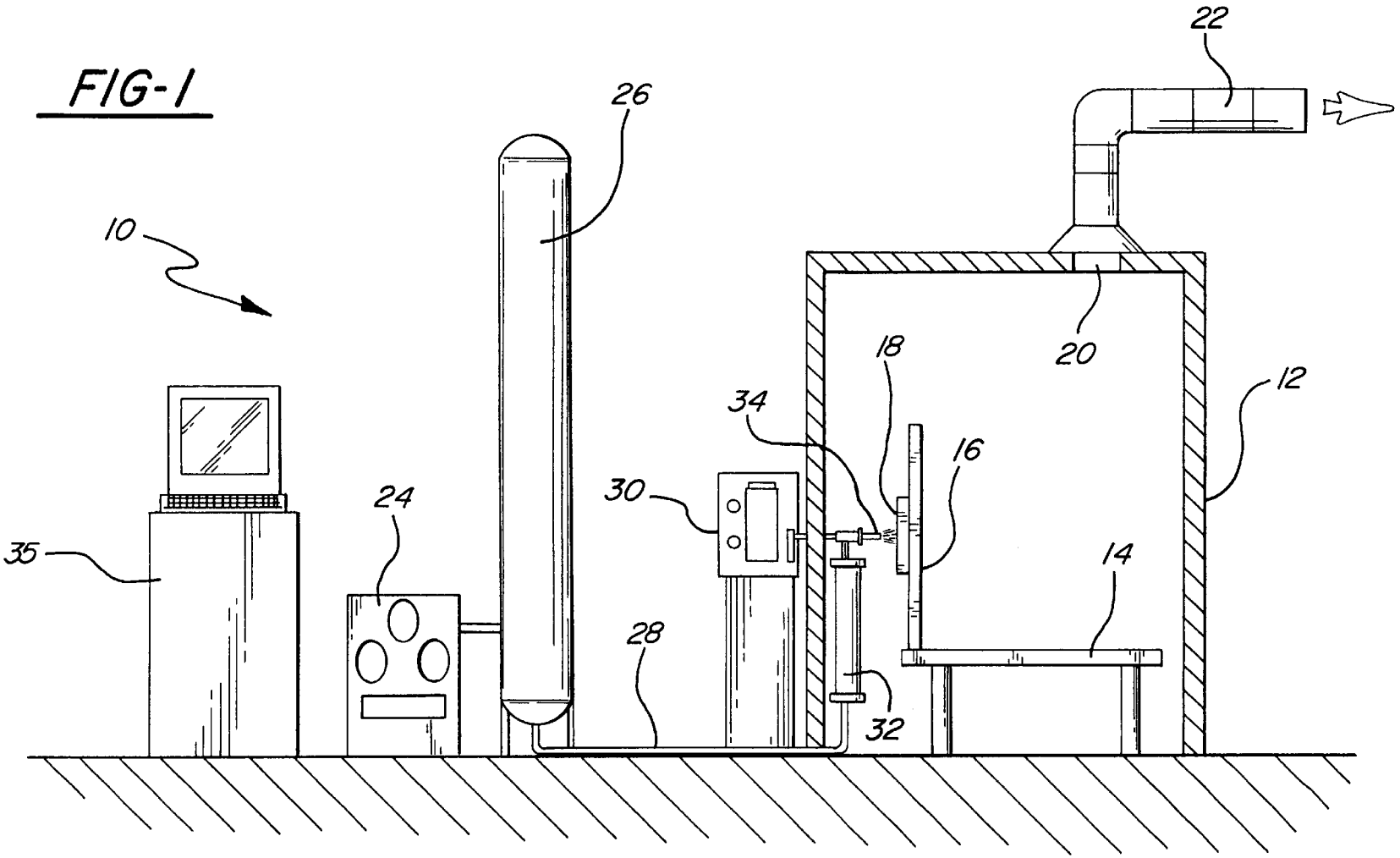
FIG. 1 is a generally schematic layout illustrating a kinetic spray system for performing the method of the present invention.

Referring first to FIG. 1 of the drawings, numeral 10 generally indicates a kinetic spray system according to the invention. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure and collects any dust or particles contained in the exhaust air for subsequent disposal.

The spray system further includes an air compressor 24 capable of supplying air pressure up to 3.4 MPa (500 psi) to a high pressure air ballast tank 26. The air tank 26 is connected through a line 28 to both a high pressure powder feeder 30 and a separate air heater 32. The air heater 32 supplies high pressure heated air to a kinetic spray nozzle 34. The powder feeder mixes particles of spray powder with unheated high pressure air and supplies the mixture to a supplemental inlet of the kinetic spray nozzle 34. A computer control 35 operates to control the pressure of air supplied to the air tank 32 and the temperature of high pressure air supplied to the spray nozzle 34.

Figure 2:
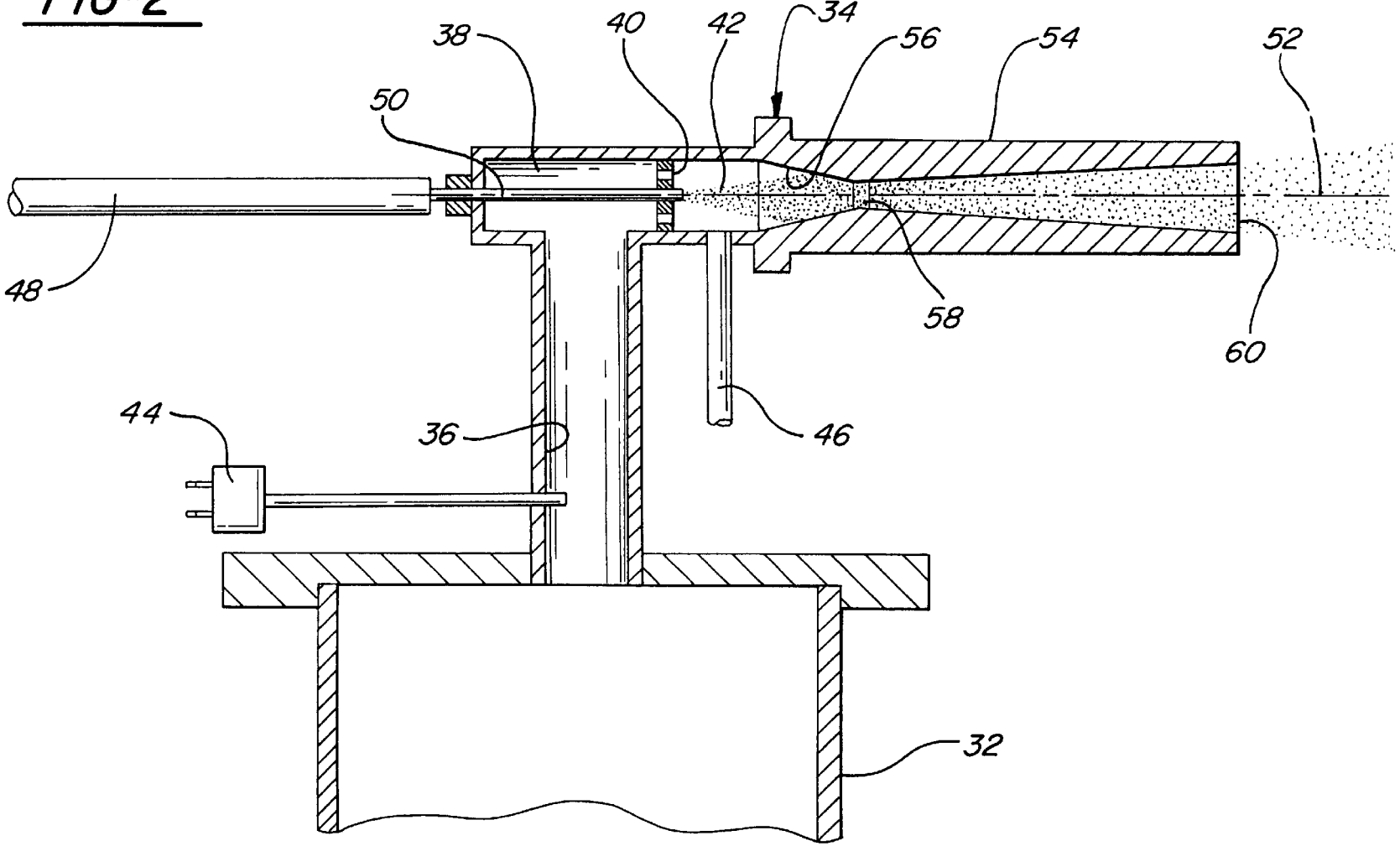
FIG. 2 is an enlarged cross-sectional view of a kinetic spray nozzle used in the system for mixing spray powder with heated high pressure air and accelerating the mixture to supersonic speeds for impingement upon the surface of a substrate to be coated.

FIG. 2 of the drawings schematically illustrates the kinetic spray nozzle 34 and its connection to the air heater 32 via a main air passage 36. Passage 36 connects with a premix chamber 38 which directs air through a flow straightener 40 into a mixing chamber 42. Temperature and pressure of the air or other gas are monitored by a gas inlet temperature thermocouple 44 connected with the main air passage 36 and a pressure sensor 46 connected with the mixing chamber 42.

The mixture of unheated high pressure air and coating powder is fed through a supplemental inlet line 48 to a powder feeder injection tube 50 which comprises a straight pipe having a predetermined inner diameter. The pipe 50 has an axis 52 which is preferably also the axis of the premix chamber 38. The injection tube extends from an outer end of the premix chamber along its axis and through the flow straightener 40 into the mixing chamber 42.

Mixing chamber 42, in turn, communicates with a de Laval type nozzle 54 that includes an entrance cone 56 with a diameter which decreases from 7.5 mm to a throat 58 having a diameter of 2.8 mm. Downstream of the throat 58, the nozzle has a rectangular cross section increasing to 2 mm by 10 mm at the exit end 60.

In its original form, as reported in the previously mentioned Van Steenkiste et al. article, the injection tube 50 was formed with an inner diameter of 2.45 mm while the corresponding diameter of the main air passage 36 was 10 mm. The diameter ratio of the main air passage to the injector tube was accordingly 4/1 while the cross-sectional area ratio was about 17/1. This system was modeled fundamentally after the prior Alkhimov et al. apparatus shown in FIG. 5 of his patent wherein the comparable cross-sectional area ratio was reported as 5–15/1. Possibly because Alkhimov's apparatus used lower gas pressures and temperatures, the calculated speed or Mach number of the gas at the exit of the nozzle was varied from about 1.5 to 2.6 whereas tests of the above described apparatus with the 2.45 mm injector tube were conducted at a Mach number of about 2.65.

Some general characteristics of the original and improved spray systems were as follows:

| | |
|---|---|
| Nozzle Mach No. | 2.65 |
| Gas pressure | 20 atmospheres |
| Gas temperature | 300–1200° F. |
| Working gas | Air |
| Gas flow rate | 18 g/s |
| Powder flow | 1.12 g/s |
| Particle size | 1–50 μm (microns) |

Comparative tests were run with the original system to establish the capabilities of the system using metal powders with various ranges of particle sizes. Materials tested included aluminum, copper and iron. The characteristics of the original system as used in these tests were as follows:

| | |
|---|---|
| Main inlet duct dia. | 10 mm |
| Injection tube dia. | 2.45 mm |
| Diameter ratio | 4/1 |
| Area ratio | 17/1 |

Table 1 tabulates data from test runs using copper powder of various ranges of particle sizes applied to a brass substrate.

TABLE 1

| | Run No. | | | |
|---|---|---|---|---|
| | 1 | 2 | 3 | 4 |
| Powder rate-g/m | 94.93 | 133.92 | 72.5 | 70.28 |
| Coating weight-g | 44.9 | 51.4 | NA | NA |
| Deposit efficiency | 23.65% | 19.19% | NA | NA |
| Powder size-μm | <45 | <45 | 63–106 | 45–63 |
| Heated Air temp | 900 F. | 900 F. | 900 F. | 900 F. |
| Feeder rpm | 500 | 500 | 500 | 500 |

These tests showed that with the system, as originally developed according to the earlier work of Alkhimov et al and discussed in U.S. Pat. No. 5,302,414 and the Van Steenkiste et al. article, kinetic coatings were able to be applied with coating powders having particle sizes smaller than 45 microns, as in test runs 1 and 2. However, when powder particle sizes were made larger than 45 microns as in test runs 3 (63–106 microns) and 4 (45–63 microns), these larger particles did not adhere to the substrate so that coatings were unable to be formed by this process.

It was reasoned that each particle must reach a threshold velocity range in order to be sufficiently deformed by impact on the substrate to give up all of its momentum energy in plastic deformation and thus adhere to the substrate instead of bouncing off. Smaller particles may be more easily accelerated by the heated main gas flow and are thereby able to reach the threshold velocity range and adhere to form a coating. Larger particles may not reach this velocity and thus fail to sufficiently deform and, instead, bounce off of the substrate. Recognizing that the speed of air able to be reached in the sonic nozzle increases as the square root of the air temperature, it was then reasoned that the air velocity might be increased by reducing the flow of unheated powder feeder air relative to the heated main air flow that accelerates the particles of powder in the nozzle. The resulting temperature of the mixed air flow through the nozzle should then be greater and provide higher air velocities to accelerate the larger particles to the threshold velocity. To test this thesis, the original powder feeder tube of 2.45 mm was replaced by a new smaller tube of 0.89 mm diameter. The characteristics of this modified system as formed in accordance with the invention are as follows:

| | |
|---|---|
| Main inlet duct dia. | 10 mm |
| Injection tube dia. | 0.89 mm |
| Diameter ratio | 11/1 |
| Area ratio | 126/1 |

Comparative tests were then run with the new system in which powder coatings were successfully applied using the kinetic coating process with copper, aluminum and iron powder particles up to 106 microns. Table 2 tabulates exemplary data from test runs using copper powders of various ranges of particle sizes applied to a brass substrate.

TABLE 2

| | Run No. | | | | | | | | | |
|---|---|---|---|---|---|---|---|---|---|---|
| | 1 | 2 | 3 | 4 | 5 | 6 | 7 | 8 | 9 | 10 |
| Powder rate-g/m | 22 | 52.39 | 50.77 | 51.58 a | 54.85 | 51.58 avg | 35.85 avg | 25.66 | 38.1 | 41.5 |
| Coating weight-g | 15.1 | 66.7 | 69.6 | 8.2 | 42 | 59.5 | 67.3 | 60.9 | 53.6 | 58.7 |
| Deposit efficiency | 45.75% | 25.46% | 27.42% | 21.2% | 38.28% | 28.84% | 75.1% | 59.32% | 70.34% | 70.75% |
| Powder size-$\mu$m | <45 | <45 | <45 | <45 | <45 | <45 | 63–106 | 63–106 | 45–63 | 63–106 |
| Heated Air temp | 900 F. | 900 F. | 900 F. | 900 F. | 900 F. | 900 F. | 900 F. | 900 F. | 900 F. | 900 F. |
| Feeder rpm | 250 | 500 | 500 | 500 | 500 | 500 | 500 | 250 | 500 | 500 |

These data show that by reducing the diameter of the powder feeder tube, the modified apparatus and system was able to produce kinetic coatings with coating powder particles of a greatly increased size up to at least 106 microns instead of being limited to less than 50 microns as was the previous apparatus. This improvement is highly advantageous since the larger sizes of coating powders are apparently both more efficient in coating application but also are safer to use. Coatings formed with the larger particles also may have a lower oxide content due to the lower surface to volume ratios of the large particles.

In further testing of the invention, the sonic nozzle apparatus of the system was further modified by substituting a still smaller powder injection tube having an inner diameter of only 0.508 mm. With this modification, the diameter ratio is increased to 20/1 and the area ratio to 388/1. Testing of this embodiment also showed the capability of forming coatings with coating powder particles up to 106 microns. However, some difficulty was encountered in maintaining the flow of the larger powder particles through the smaller diameter feeder tube. The indication is that the minimum diameter of the powder feeder tube is limited only by the ability of the system to carry coating particles therethrough and not by any limitation of the ability to coat the particles onto a substrate.

The testing of the improved apparatus and system of the invention has demonstrated the capability to form kinetic coatings of powder particles sized in a range between 50 and 106 microns ($\mu$m) whereas the previously developed systems were admittedly limited to use with powder particles of less than 50 microns. While testing of the improved apparatus and method have been limited to a relatively few coating powders and substrates, the extensive testing of the prior art apparatus and method with a large range of coating powders and substrates, as indicated in part in the previously mentioned U.S. Pat. No. 5,302,414 as well as in other published information, leaves little doubt that the apparatus of this invention will work equally well with these same materials and others comparable thereto. The invention as claimed is accordingly intended to cover the use of all such materials which the language of the claims may be reasonably understood to include:

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

PARTS LIST

10. kinetic spray system
12. enclosure
14. support table
16. mounting panel
18. work holder
20. air outlet
22. exhaust conduit
24. air compressor
26. air ballast tank
28. line
30. powder feeder
32. air heater
34. kinetic spray nozzle
35. computer control
36. main air passage
38. premix chamber
40. flow straightener
42. mixing chamber
44. thermocouple
46. pressure sensor
48. inlet line
50. injection tube

52. axis

54. nozzle

56. entrance cone

58. throat

60. exit end

62.

64.

66.

68.

70.

72.

74.

76.

78.

80.

82.

84.

86.

88.

90.

92.

94.

96.

98.

100.

What is claimed is:

1. Apparatus for kinetic coating of particles to an substrate, the apparatus comprising:

a nozzle body including a mixing chamber upstream of a supersonic nozzle;

A main air flow passage connecting the mixing chamber with a source of high pressure air;

an injector tube extending into the mixing chamber in axial alignment with said nozzle, said main air flow passage and said injector tube having a cross-sectional area ratio of at least 80/1;

connecting means connecting the injector tube with a source of coating particles entrained in high pressure air for mixing with air flow in the main air passage;

said nozzle being configured to accelerate the flow of air mixed with coating particles to a supersonic flow rate adequate to coat said particles onto a substrate by impingement without melting of the particles in the air stream.

2. Apparatus as in claim 1 wherein said area ratio is about 125/1.

3. Apparatus as in claim 1 wherein said main air flow passage and said injector tube are each cylindrical and have a diameter ratio of at least 9/1.

4. Apparatus as in claim 3 wherein said diameter ratio is at least 11/1.

5. Apparatus as in claim 1 including an air flow straightener upstream of the mixing chamber and defining a premix chamber connected to the main air flow passage upstream of the air flow straightener.

6. Apparatus as in claim 1 in combination with:

an air heater communicating with said main air passage for heating the main air flow to increase its flow rate from said nozzle;

a high pressure powder feeder communicating with said injector tube for delivering airborne powder thereto; and a source of pressurized air communicating with the air heater and the powder feeder and operable to provide air thereto at a pressure adequate to maintain a supersonic flow rate of the air and powder mixture discharged from the nozzle.

7. Apparatus as in claim 6 and including control means operative to control air pressure to the main air passage and to the powder feeder and the air temperature to the main air flow passage to preset conditions during operation of the apparatus in coating of a substrate.

* * * * *